United States Patent [19]

Hellmig et al.

[11] 4,036,646

[45] July 19, 1977

[54] COLOR CORRECTION OF UNWANTED SIDE DENSITIES IN LIGHT-SENSITIVE COLOR PHOTOGRAPHIC ELEMENTS

[75] Inventors: Ehrhard Hellmig; Erwin Ranz, both of Leverkusen, Germany

[73] Assignee: AGFA-Gevaert, A.G., Leverkusen, Germany

[21] Appl. No.: 555,150

[22] Filed: Mar. 4, 1975

[30] Foreign Application Priority Data

Mar. 8, 1974 Germany ..... 2411105

[51] Int. Cl.[2] ..... G03C 7/00; G03C 7/04; G03C 3/00

[52] U.S. Cl. ..... 96/74; 96/5; 96/7; 96/8; 96/10

[58] Field of Search ..... 96/5, 6, 74, 7, 27, 96/8, 10, 69

[56] References Cited

U.S. PATENT DOCUMENTS

| | | | |
|---|---|---|---|
| 3,206,310 | 9/1965 | Herz | 96/69 |
| 3,684,501 | 8/1972 | Herremans | 96/6 |
| Re. 22,764 | 1/1943 | Dearing | 96/8 |

*Primary Examiner*—David Klein
*Assistant Examiner*—Louis Falasco
*Attorney, Agent, or Firm*—Connolly and Hutz

[57] ABSTRACT

A color photographic material having three light-sensitive silver halide emulsion layers separately sensitized to different regions of the spectrum and containing an each colorless coupler for the production of partial color images, is partly fogged in one of said layers to produce on color development in unexposed areas a color fog with a density of between 0.25 and 0.75 suited to compensate for undesired side densities of the image dye in one or more of the other of said layers.

5 Claims, 1 Drawing Figure

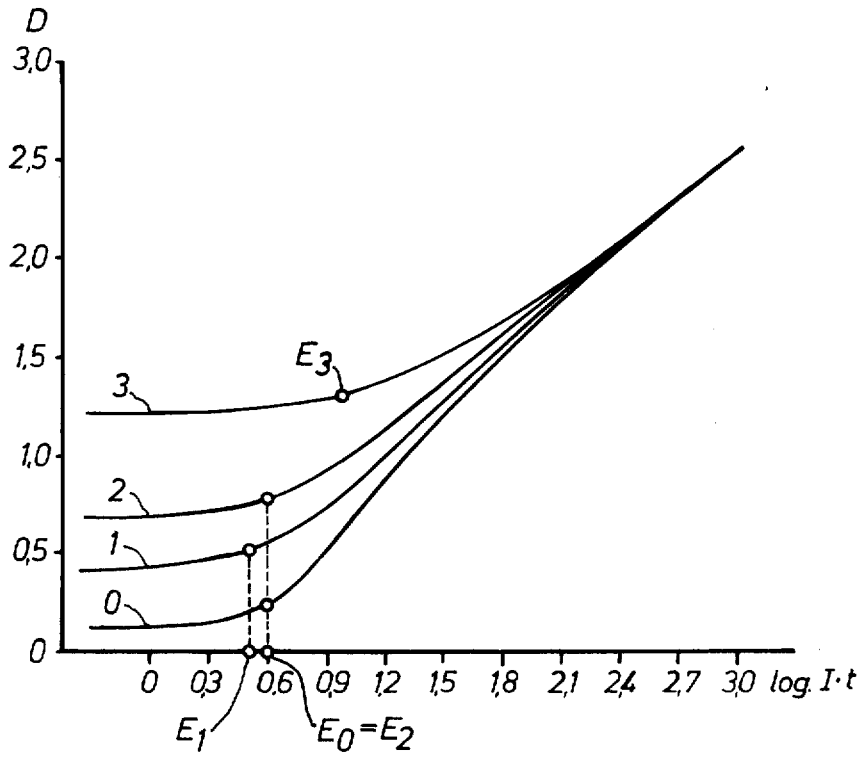
D
3,0
2,5
2,0
1,5
1,0
0,5
0
3
2
1
0
$E_3$
0
0,3
0,6
0,9
1,2
1,5
1,8
2,1
2,4
2,7
3,0
log. I·t
$E_1$
$E_0=E_2$

COLOR CORRECTION OF UNWANTED SIDE DENSITIES IN LIGHT-SENSITIVE COLOR PHOTOGRAPHIC ELEMENTS

This invention relates to a light-sensitive color photographic multilayer material with built-in means for the automatic color correction of unwanted color side densities of image dyes.

It is well known that when a negative multilayer color film is copied on a positive multilayer color film or on color copying paper, certain falsifications of color occur which are due to the optical imperfection of the image dyes, the so-called side densities of the dyes (sensitometrically also known as "side graduations"). These defects in color reproduction are eliminated in known manner by means of so-called masks, that is to say images which are opposite in graduation to the image of a particular color which is required to be corrected (partial color image; yellow, magenta or cyan color in three-layer materials), but flatter than the image which is required to be corrected and different therefrom in colour. For optimum color correction, the masking image should correspond both in color and in magnitude of graduation (although the graduation should be opposite) to the unwanted image of side color density of the partial color image which is required to be corrected. Thus, for example, a magenta dye with a side gradation of 0.30 in the blue spectral region (yellow side image) can be masked by a masking image which is yellow in color and has an opposite graduation of 0.30.

In modern multicolor films, the means for such masks are already incorporated in the film when it is being manufactured (so-called built-in masks or integral masks) and such masks then automatically come into appearance after exposure of the film followed by processing in the photographic bath (hence also known as automatic masks).

These modern masking processes are in most cases based on the use of colored couplers which, after exposure and during photographic processing, are recoupled to a different color (the so-called image color) and the intrinsic color of the coupler disappears accordingly. Thus, for example, a coupler used for a magneta image is yellow in color if the side density is required to be compensated in the blue third of the spectrum.

The use of colored masking couplers for the production of color films has, however, considerable disadvantages. Since these couplers can never be used alone but must be mixed with at least one colorless coupler on account of their own strong intrinsic color, competing reactions take place during color development of this two-component or multicomponent system owing to the differing coupling velocities of the different couplers, and these competing reactions result in deviations from the desired graduation of the mask (non-linear relationship between gradation of the mask and image gradation), and this has a deleterious effect on the color reproduction in the copy. In addition, such masking couplers often require special methods for incorporating them in the film material, which again renders the preparation of the light-sensitive emulsions more difficult, apart from the fact that the necessity to prepare and keep in stock a colored coupler in addition to a colorless coupler already adds to the disadvantages.

To this is added another fundamental difficulty: According to the principles of colored couplers, only certain side gradations of certain image dyes can be masked since the color of the coupler absorbs actinic light and the sensitivity of the image layer or layers underneath the layer which contains the colored masking coupler is thereby reduced. Thus, for example, a cyan or green colored magenta coupler would reduce the red sensitivity of the layer which contains the cyan coupler whereas a red colored yellow coupler would reduce the green sensitivity of the magenta layer. Such colored masking couplers would, in principle, be necessary for masking the side density of the magenta dye in the red region of the spectrum and for masking the side density of the yellow dye in the green region of the spectrum but, in practice, they simply cannot be used in films of high light-sensitivity because, with the ever increasing standards of light sensitivity demanded in photographic materials, even the slightest deleterious effect on this property must be avoided. Another disadvantage of this possible method of masking unwanted side densities lies in the great difficulty in preparing masking couplers which have the desired color.

In another known masking process, which makes use of the vertical vicinal effects or interimage effects, these difficulties do not occur. In this process one or more of the silver halide emulsions layers which contain color couplers for producing the partial color images in a multi-layered material are slightly fogged so that they can develop without any further exposure to light. If at least one of the two other color-forming individual layers is exposed imagewise and the material is developed in the usual manner, the development kinetic processes which then take place in and between the individual layers of the color film gave rise to an image in the latently fogged layer only in those areas which correspond to the unexposed areas of the adjacent layer, since development of the fog is inhibited in those parts which correspond to the exposed areas of the adjacent layer. A flat image is obtained in the latently fogged layer. Its gradation is opposite to that of the image in the layer which has been exposed to light, i.e. a mask is formed for this image. Since, as is clear from the above comments, this process is not restricted to the use of colored components, the loss of light and hence loss of sensitivity due to the intrinsic color of colored components are eliminated. In the past, however, only very flat masks have been produced by this process, and maximum fog densities of about 0.20 have been employed. Higher fog densities were considered to be harmful since it was assumed that fogging would cause a substantial reduction in sensitivity, particularly in photographic materials with a flat gradation. Any loss of sensitivity must, of course, be avoided in the color films of maximum sensitivity used in practice. For this reason, the stronger side densities of certain image dyes continued to be masked with conventional means, i.e. a colored masking coupler was again used for these purposes, so that the advantages which the process set out to achieve were lost.

It is an object of this invention to provide means for producing built-in and automatic masks in multi-layered color photographic films, by which means optimum masking can be achieved in a simple and economical manner.

A light-sensitive photographic multi-layered material has now been found which comprises a blue-sensitive silver halide emulsion layer containing a yellow-forming coupler therein, a green-sensitive silver halide emulsion layer containing therein a magenta forming coupler and a red sensitive silver halide emulsion containing therein a cyan-forming coupler, and in at least one (first) of said light sensitive silver halide emulsions layers the image dye produced by chromogenic development has an unwanted side density, and at least one other (second) of said light-sensitive silver-halide emulsion layers is partially fogged to be developable so that the gradation of the unwanted side density of the image dye in the first layer is partly or completely compensated, depending on the requirement, and when chromogenic development is carried out a color fog with a density of between 0.25 and 0.75 and a color which corresponds to the unwanted side density of the image dye in the first layer which is required to be masked is produced in the unexposed areas of the second silver halide emulsion layer. According to a particularly preferred embodiment of the invention, the fogged silver halide emulsion layer contains a silver halide emulsion which in the unfogged state has a steeper gradation in the lower part of the gradation curve than the nominal gradation in the upper part of the curve, and the degree of fogging is adjusted so that fogging produces flattening of the gradation in the lower part of the curve up to the nominal gradation so that the overall effect in the fogged silver halide emulsion is that a substantially rectilinear gradation curve is obtained with a gradation in the region of about 0.5 to 1.2.

The present invention is based on the finding that the steeper the masking gradation is required to be, i.e. the greater the side gradation of the image dye which is required to be masked, the higher must be the density of the mask (masking fog). Thus, for example it was found that complete masking of the yellow side gradation of a magenta dye which amounts to 25% of the gradation of the main magenta gradation requires a yellow fog of 0.70 in the yellow image layer of the multilayered color film.

This invention is surprising, particularly because it has previously been held that a higher fog would substantially reduce the threshold sensitivity, which as is known is measured at a density of 0.1 above the fog (DIN 4512, sheet 1). According to this previously held view, this deleterious effect is all the more pronounced the flatter the gradation of the given individual layer of the color film. This applies particularly to the gradation of the yellow partial image since, as is well known, it is the flattest of the three partial images of a three-layered color film. For this reason, the use of higher fogging densities has previously has been avoided. In contrast to these views, it has been found, in accordance with the present invention, that at certain fog densities in the region of between 0.25 and 0.75 the expected reduction in sensitiviy does not occur. A certain increase in sensitivity may even occur within a narrower range of the fog densities. This effect is illustrated in the accompanying figure. In the graph, the logarithm of exposure log I.t is plotted along the abscissa against the density which is plotted along the ordinate. The curve O shows the variation in color density of the individual layer of a color film according to the invention, e.g. the green sensitive layer with a magenta coupler, and moreover in the unfogged state. The threshold sensitivity measured at 0.1 above the fog is defined by the point $E_o$. The course of the curve clearly shows a steeper gradation in the region of lower densities and a slightly flatter, rectilinear gradation in the region of higher densities.

If this silver halide emulsion layer is fogged to produce fog density of 0.42, e.g. by controlled uniform exposure behind a green filter, the threshold sensitivity is not reduced but in this case is even shifted slightly to the left $E_1$ i.e. the emulsion has a slightly higher sensitivity. The corresponding curve is marked 1 in the figure. If a higher fog with a fog density of 0.70 is produced, the threshold sensitivity is reduced compared with $E_1$ but the value obtained $E_2$ is still not below the initial value $E_o$ (see curve 2 of the accompanying figure). It is only at still higher degrees of fogging that a loss in sensitivity can be observed, as shown by the threshold sensitivity $E_3$ of curve 3.

The example illustrated in the figure, can, of course, be modified in various ways. The present invention can be applied to any of the light-sensitive partial layers of a multi-layered color photographic material, e.g. to the red sensitive layer with cyan-forming coupler, to the green sensitive layer with magenta-forming coupler or particularly to the blue sensitive layer with yellow-forming coupler. The latter is particularly important on account of the relatively high side density in the blue spectral region of the magenta image dye formed from the magenta-forming coupler since, of all the possible masks of a color film, the one used for compensating this side density in the yellow layer must produce the steepest masking gradation. The fog density (masking density) can, of course, be adjusted to various values according to the desired masking gradation. In conventional masked color negative films, the fog densities are generally in the region of 0.5 to 1.

The rectilinear form of color density curves for fogged emulsions is preferred although, in special cases, other forms of curves can be obtained by using a suitable starting emulsion.

Fogging of the emulsion layer may be carried out in known manner, e.g. by chemical fogging or exposure to light. If desired, several fogging methods may be employed at the same time. Fogging may be carried out at any stage of preparation of the emulsion or of the photographic material.

Chemical fogging is generally carried out before casting. For example, a 10−2 molar aqueous solution of formamidine sulphinic acid may be added to the casting solution in a certain quantity per g of silver nitrate at pH 6.8 and pAg 9, and the mixture may then be digested at /40° C for 15 minutes. If the silver halide emulsion is obtained by mixing various partial emulsions, e.g. with differing particle size distributions, separate chemical fogging may be carried out on one or more of the partial emulsions before they are mixed. When the known double layer principle is applied, the layers for producing a partial colour image from two partial layers of different sensitivities and different or equal degrees of fogging may be combined.

A fog may also be produced by exposure to light in the emulsion when it is ready for casting or when it has already been partly or completely cast. In the latter case, however, it is essential to use colored light. For this purpose, controlled exposure of one of the three light-sensitive color recording layers is carried out on the finished material behind a suitable color separation filter (e.g. Agfa-Gevaert No. U 449 blue, U 531 green, L622 red); the degree of fogging can be adjusted by varying the exposure time or intensity of light.

The masking process according to the invention is based on the vertical vicinal effects or interimage effects according to which the development processes in a light-sensitive layer, in this case particularly the layer which is partially fogged, are influenced to a significant extent by the development processes in the adjacent light-sensitive layers. In particular, in this case development of the fog is controlled by the intensity of development of the corresponding image areas in the adjacent layer. It is clear that the masking process according to the invention is particularly easy to carry out with compounds which liberate diffusible development inhibitors on development.

Such compounds which liberate development inhibitors include, for example, the known DIR couplers (DIR = development inhibitor releasing) which are color couplers which contain a releasable substituent at the coupling point, and when color coupling takes place this substituent is released from the coupler molecule as a diffusible development inhibitor and at the same time a dye is produced from the residue of the coupler molecule. DIR couplers of this kind have been described, for example, in U.S. Pat. No. 3,227,554.

Particularly suitable development inhibitor releasing compounds, however, are those which react with colour developer oxidation products to liberate a development inhibitor without at the same time forming a dye. Compounds of this kind, which may be termed DIR compounds in contrast to the DIR couplers, have been described, for example, in U.S. Pat. No. 3,632,345.

The masking process according to the invention, however, is in no way restricted to the presence of DIR couplers or DIR compounds.

If complete masking of all the unwanted side densities cannot be achieved by the process according to the invention, a further improvement can be obtained by combining the process with known masking methods. The known colored masking couplers should be particularly mentioned here. The disadvantages mentioned above of these coloured masking couplers are in this case no longer so important because in cases where any further masking is necessary at all, they are generally only used to deal with slight side densities so that they are only required at low concentration and therefore produce only a slight color density in the unprocessed material.

The light-sensitive silver halide emulsion layers of the photographic material according to the invention have differing spectral sensitivities and each contain at least one non-diffusible colorless color coupler for producing an image dye with a colour which, as a rule, is complementary to the spectral sensitivity. The red sensitive layer consequently contains at least one non-diffusible color coupler for producing the cyan partial color image, generally a coupler of the phenol or α-naphthol series. The green sensitive layer contains at least one non-diffusible color coupler for producing the magenta partial color image, usually a color coupler of the 5-pyrazolone or indazolone series. The blue sensitive layer unit, finally, contains at least one nondiffusible color coupler for producing the yellow partial color image, generally a color coupler containing an open chain keto methylene group. Large numbers of color couplers of these types are already known and have been described in numerous Patent Specifications. Reference may be made for example, to the publication "Farbkuppler" by W.PELZ in "Mitteilungen aus den Forschungslaboratorien der Agfa, Leverkusen/Munchen" Volume III (1961) and to K. Venkataraman, "The Chemistry of Synthetic Dyes", Vol. 4, pages 341 - 387, Academic Press, 1971.

The non-diffusible colorless color couplers as well the non-diffusible colored masking couplers, if any, and the non-diffusible compounds which release a development inhibitor are added to the light-sensitive silver halide emulsions by the usual methods. If they are water-soluble or alkali soluble compounds, they may be added to the emulsion in the form of aqueous solutions, optionally with the addition of organic solvents which are miscible with water, such as ethanol, acetone or dimethylformamide. If the non-diffusible color couplers and the non-diffusible development inhibitor releasing compounds are insoluble in water or alkalies, they may be emulsified in known manner, e.g. by mixing a solution of these compounds in a low boiling organic solvent directly with the silver halide emulsion or first mixing it with an aqueous gelatine solution and then evaporating off the organic solvent. An emulsion of the given compound in gelatine obtained in this way is subsequently mixed with the silver halide emulsion. In some cases, so-called coupler solvents or oil formers are used in addition to emulsify such hydrophobic compounds. These coupler solvents are generally higher boiling organic compounds in which the non-diffusible color couplers and development inhibitor releasing compounds which are required to be emulsified in the silver halide emulsions become enclosed in the form of oily droplets. Reference may be made in this connection to U.S. Pat. No. 2,322,027; 3,689,271; 3,764,336 and 3,765,897, for example.

The usual silver halide emulsions are suitable for the present invention. They may contain silver chloride, silver bromide or mixtures thereof, optionally with a small silver iodide content of up to 10 mols percent.

The binder used for the photographic layers is preferably gelatine although this may be partly or completely replaced by other natural or synthetic binders. Suitable natural binders include, e.g. alginic acid and its derivatives such as its salts, esters or amides, cellulose derivatives such as carboxymethylcellulose, alkyl celluloses such as hydroxyethylcellulose, starch or its derivatives such as ethers or esters or carrageenates. Suitable synthetic binders include polyvinyl alcohol, partially saponified polyvinyl acetate, polyvinylpyrrolidone and the like.

The emulsions may also be chemically sensitized, e.g. by the addition of sulphur compounds at the chemical ripening stage, for example allylisothiocyanate, allylthiourea, sodium thiosulphate and the like. Reducing agents may also be used as chemical sensitizers, e.g. the tin compounds described in Belgian Pat. Specifications No. 493,464 or 568,687, polyamines such as diethylene triamine or aminomethanesulphinic acid derivatives, e.g. according to Belgian Patent Specification No. 547,323.

Noble metals such as gold, platinum, palladium, iridium, ruthenium or rhodium and compounds of these metals are also suitable chemical sensitizers. This method of chemical sensitization has been described in the article by R. Koslowsky, Z. Wiss. Phot. 46, 65 to 72 (1951).

The emulsions may also be sensitized with polyalkylene oxide derivatives, e.g. with a polyethylene oxide having a molecular weight of between 1000 and 20,000, or with condensation products of alkylene oxides and aliphatic alcohols, glycols, cyclic dehydration products of hexitols, alkylsubstituted phenois, aliphatic carboxylic acids, aliphatic amines, aliphatic diamines and amides. The condensation products have a molecular weight of at least 700 and preferably more than 1000. These sensitizers may, of course, be combined in order to achieve special effects as described in Belgian Pat.

Specification No. 537,278 and in British Patent No. 727,982.

The emulsions may also be spectrally sensitized, e.g. with the usual monomethine or polymethine dyes such as acid or basic cyanines, hemicyanines, streptocyanines, merocyanines, oxonols, hemioxonols, styryl dyes or the like or trinuclear or multinuclear methine dyes, for example rhodacyanines or neocyanines. Sensitizers of this kind have been described, for example, in the work by F. M. HAMER "The Cyanine Dyes and Related Compounds" (1964), Interscience Publishers John Wiley and Sons.

The emulsions may contain the usual stabilizers, e.g. homopolar or salt-type compounds of mercury which contain aromatic or heterocyclic rings, such as mercaptotriazoles, simple mercury salts, sulphonium mercury double salts and other mercury compounds. Azaindenes are also suitable stabilizers, particularly tetra- or pentaazaindenes and especially those which are substituted with hydroxyl or amino groups. Compounds of this kind have been described in the article by BIRR. Z. Wiss. Phot. 47, 2 to 58 (1952). Other suitable stabilizers include heterocyclic mercapto compounds, e.g. phenylmercaptotetrazole, quaternay benzothizole derivatives, benzotriazole and the like.

The emulsions may be hardened in the usual manner, for example with formaldehyde or halogenated aldehydes which contain a carboxyl group, such as mucobromic acid, diketones, methanesulphonic acid esters, dialdehydes and the like.

EXAMPLE

Light-sensitive photographic material:

Arrangement of Layers

Support: Substrated cellulose triacetate support.

a. Intermediate layer of gelatine;
b. cyan layer consisting of a single emulsion or a mixture of emulsions which have been sensitized to the red region of the spectrum and a cyan-forming coupler of formula I;
c. intermediate layer of gelatine;
d. magenta layer consisting of a single emulsion or a mixture of emulsions which have been sensitized to the green region of the spectrum and a magenta-forming coupler of formula II;
e. intermediate layer of gelatine;
f. yellow filter layer;
g. yellow layer consisting of a single emulsion or a mixture of emulsions which have been sensitized to the blue spectral region and a yellow-forming coupler of formula III
h. protective layer of gelatine.

The material is hardened in the usual manner, e.g. with trisacryloylhexahydrotriazine.

I

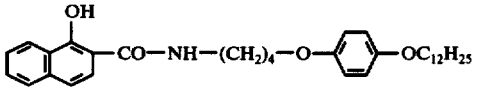

II

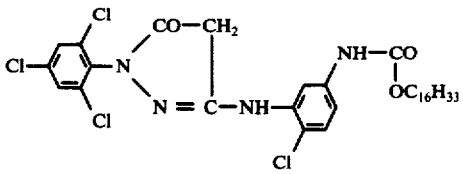

-continued

III

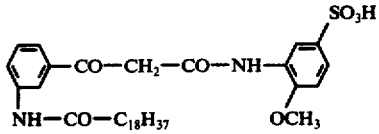

The material is varied in the composition and degree of fogging of the emulsions of the light-sensitive partial layers. *b, d* and *g*.

Processing

Determination of the gradation curves and masking of the side densities are carried out as follows:

The material is exposed behind a grey step wedge and behind a blue, green or red color separation filter, respectively, in a conventional sensitometer and the exposed material is developed in a color developer of the following composition:

2 g of the sodium salt of isopropanol diaminotetracetic acid
30 g of potassium carbonate
4 g of potassium sulphite
1.5 g of potassium bromide 2 g of hydroxylamine
5 g of color developer compound of the following

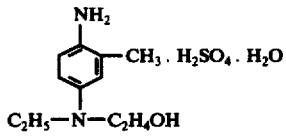

made up to 1 liter. pH is adjusted to 10.3.

Development: 5 minutes at 25° C.

The subsequent stages of processing indicated below take 8 minutes each. The bath temperature is in each case 25° C.

Short stop bath:
30 ml of acetic acid (concentrated)
20 g of sodium acetate
Water up to 1 liter
Washing
Bleaching bath:
100 g of potassium ferricyanide
15 g of potassium bromide
Water up to 1 liter
Washing
Fixing bath:
200 g of sodium thiosulphate
20 g of $NaHSO_3$
Water up to 1 liter
Final washing

Masking measurements.

The silver halide emulsion layers for the yellow, magenta and cyan partial image have the side densities summarized in the following Table when the given color couplers are used. The main densities were set at 1.00. The unwanted side densities of the image dyes were measured on individually cast emulsion layers. In the following Table 1, the colors of the partial image dyes are shown in the first line and the filters used for carrying out the measurements are indicated in the first column.

Table 1

| | | Yellow | Magenta | Cyan |
|---|---|---|---|---|
| Blue | 1) | 1.00 | 0.25 | 0.05 |
| Green | 2) | 0.15 | 1.00 | 0.11 |
| Red | 3) | 0.00 | 0.07 | 1.00 |

1) Measuring filter manufactured by Schott BG 12
2) Measuring filter manufactured by Schott VG 9
3) Measuring filter manufactured by Schott RG 2.

Below are described the masking effects obtained when a fogged magenta layer is used in the arrangement of layers described above.

Magenta mask

The magenta layer (d) in the multilayered material contains a mixture of a relatively coarse grained and a relatively fine grained silver halide emulsion. The gradations of the two individual emulsions are chosen so that when the two emulsions have been mixed the magenta layer has the magenta density curve with the properties described in Table 2 (No.O) after exposure of a grey wedge to reflected light behind a green separation filter. Fogging was carried out by uniform exposure to light behind the green separation filter U 531 of Agfa-Gevaert. The magenta fogs 0.43, 0.70 and 1.21 were produced by three exposure times of increasing length. The color density curves obtained after exposure of a grey wedge to reflected light behind the same green separation filter are also described in Table 2. The sensitivity is read off at density 0.1 above the fog (sensitivity point) and recorded in the form of log *I.t* values. The smaller the value, the higher the sensitivity. The gradation is determined on two sections of the color density curve along the abscissa, namely $\gamma_1$ between the exposure value corresponding to the sensitivity point and the exposure value which is higher by 0.8 log *I.t* units and $\gamma_2$ between the latter and another exposure value higher than this by a further 0.8 log *I.t* units.

Table 2

| No. | Fog | Sensitivity (log I . t units) | $\gamma 1$ | $\gamma_2$ |
|---|---|---|---|---|
| 0 | 0.15 natural fog | 0.6 | 1.2 | 1.0 |
| 1 | 0.43 | 0.5 | 0.75 | 0.85 |
| 2 | 0.70 | 0.6 | 0.70 | 0.75 |
| 3 | 1.21 | 0.97 | 0.45 | 0.65 |

The magenta fog 0.70 which is composed of a natural fog of 0.15 and a fog of 0.55 produced by uniform exposure to light produces the following reduction (see Table 3) in magenta side densities of the yellow and cyan layers of a multilayered arrangement (integral densities):

Table 3

| | Yellow | Magenta | Cyan |
|---|---|---|---|
| Blue | 1.0 | — | — |
| Green | −0.01 | 1.00 | −0.04 |
| Red | — | — | 1.00 |

The magenta side densities of the yellow and cyan layers are completely masked (slightly overmasked). In the magenta fog of 0.70, the gradation is practically rectilinear (as described) namely $\gamma_1 = 0.70$ and $\gamma_2 = 0.75$.

In addition, the sensitivity (0.6 log *I.t* units) of the magenta layer is not less than in the comparison material with a natural magenta fog of 0.15. In the case of a magenta fog of 0.43, the magenta side densities would be under-masked and the partial gradations not equal ($\gamma_1 = 0.75$ and $\gamma_2 = 0.85$). In the case of a magenta fog of 1.21, the magenta side densities would be overmasked and the partial gradations would again differ from each other ($\gamma_1 = 0.45$ and $\gamma_2 = 0.65$) and moreover the sensitivity (0.97 log *I.t* units) would be too low.

We claim:

1. A light sensitive color photographic multilayer material having built-in means for color correction of unwanted side densities, essentially consisting of supported spectrally sensitive silver halide emulsion layers in superimposed relationship comprising a blue-sensitive silver halide emulsion layer with a colorless yellow-forming coupler, a green-sensitive silver halide emulsion layer with a colorless magenta-forming coupler and a red-sensitive silver halide emulsion layer with a colorless cyan-forming coupler, at least a first of said spectrally sensitive emulsion layers having a coupler providing an image dye produced by chromogenic development having a main density in the spectral sensitivity range of said first emulsion layer and an unwanted side density in the spectral sensitivity range of a second of said spectrally sensitive emulsion layer and said second spectrally sensitive emulsion layer being partially fogged and developable to form on chromogenic development a dye of a color that compensates for the unwanted side density in said first emulsion layer, and a yellow filter layer wherein the improvement comprises said second spectrally sensitive emulsion layer has been fogged to a degree that produces on chromogenic development a color density of between 0.25 and 0.75 in the unexposed areas of said second emulsion layer and said second emulsion layer having in the fogged state a threshold photosensitivity not less than that in the unfogged state.

2. The light-sensitive photographic material as claimed in claim 1, wherein said second spectrally sensitive emulsion layer contains an emulsion having in the fogged state a substantially rectilinear color density curve with a gradation between 0.5 and 1.2 said emulsion in the unfogged state having in the lower part of color density curve a higher gradation than in the upper part of that curve.

3. The light-sensitive photographic material as claimed in claim 1, wherein said first spectrally sensitive emulsion layer is adjacent to said second spectrally sensitive emulsion layer.

4. A light sensitive color photographic multilayer material having built-in means for color correction of unwanted side densities, essentially consisting of supported spectrally sensitive silver halide emulsion layers in superimposed relationship comprising a blue-sensitive silver halide emulsion layer with a colorless yellow-forming coupler, a green-sensitive silver halide emulsion layer with a colorless magenta-forming coupler and a red-sensitive silver halide emulsion layer with a colorless cyan-forming coupler, at least one of the blue sensitive and the red sensitive of said spectrally sensitive emulsion layers having a coupler providing a first image dye produced by chromogenic development having a main density in the respective spectral sensitivity range of said blue sensitive or red sensitive emulsion layer and an unwanted side density in the spectral sensitivity range of the green sensitive emulsion layer and said green sensitive emulsion layer being partially fogged and developable to form on chromogenic development a second color image that compensates for said unwanted side density, and a yellow filter layer wherein the improvement comprises said green sensitive emulsion layer has been fogged to a degree that produces on chromogenic development a color density of between 0.43 and 0.70 in the unexposed areas of said emulsion layer and said green sensitive emulsion layer having in the fogged state a threshold photosensitivity not less than that in the unfogged state.

5. The light-sensitive material as claimed in claim 4 wherein the green sensitive emulsion layer has in the fogged state a threshold photosensitivity in log *I.t* units as measured by points on the characteristic curve which are above the exposure required to produce visibility which is not less than the threshold sensitivity of the green sensitive emulsion layer in the unfogged state.

* * * * *